US005303572A

United States Patent [19]

Knudson

[11] Patent Number: 5,303,572

[45] Date of Patent: Apr. 19, 1994

[54] PANEL BENDING APPARATUS AND METHOD

[76] Inventor: Gary A. Knudson, 17356 W. 57th Ave., Golden, Colo. 80401

[21] Appl. No.: 879,561

[22] Filed: May 7, 1992

[51] Int. Cl.[5] ..... B21D 5/01; B21D 5/16

[52] U.S. Cl. ..... 72/385; 72/389; 72/414

[58] Field of Search ..... 72/383, 389, 380, 385, 72/414

[56] References Cited

U.S. PATENT DOCUMENTS

| | | | |
|---|---|---|---|
| 4,220,031 | 9/1980 | Naslund | 72/389 |
| 4,347,726 | 9/1982 | Naslund . | |
| 4,449,388 | 5/1984 | Aberg | 72/385 |
| 4,603,572 | 8/1986 | Van Breukelen et al. . | |

FOREIGN PATENT DOCUMENTS

| | | | |
|---|---|---|---|
| 0049313 | 4/1982 | European Pat. Off. . | |
| 459481 | 11/1989 | Sweden . | |
| 2101507 | 1/1983 | United Kingdom | 72/385 |

*Primary Examiner*—David Jones

*Attorney, Agent, or Firm*—Fields, Lewis, Pittenger & Rost

[57] ABSTRACT

Apparatus and method for bending channel-shaped panels includes a crimping assembly having a stationary bottom die, movable top die and a drive that moves the top die past the bottom die to form a continuous crease in both the bottom and side walls to bend the panel to a selected angle. A pair of the crimping assemblies side by side form a double bend for pitched roof panels. Each crimping assembly has a guide for the top die which includes end members with slots defining cam surfaces at the ends of the bottom die and lever members with cam pins pivotally mounted to the ends of each top die. Hydraulic cylinders engage the lever members to move the cam pins against the cam surfaces to perform a straight line movement of the top die past the bottom die to perform a transverse continuous crease in the base wall and side walls of the panel and the ends of the panel are turned about the crease for performing a bend of a selected angle in the panel.

23 Claims, 5 Drawing Sheets

PANEL BENDING APPARATUS AND METHOD

TECHNICAL FIELD

This invention relates to a method and apparatus for bending panels and the like.

BACKGROUND ART

A number of different types of apparatus and methods have been employed for bending panels.

U.S. Pat. Nos. 4,347,726 and 4,603,572 disclose apparatus and methods for this purpose. In the past when channel-shaped panels have been formed, the creases formed in the material go in from the base or bottom wall and out from the side. Some of the bending apparatus heretofore provided is for bending a flat plate and others are directed to bending channel-shaped panels.

EPC No. 0,049,313 discloses a panel bending apparatus using a multi-part die and a variable adjustable pressing force.

Sweden No. 459,481 discloses a method and apparatus for bending corrugated sheet using a flat bottom die and a movable top die that has the effect of crushing the corrugations but the movable die does not go past the plane of the panel. Subsequent bending is done manually.

DISCLOSURE OF THE INVENTION

In accordance with the present invention, there is provided an apparatus and method for bending a generally channel-shaped panel wherein transverse crimps are simultaneously made inwardly from both the intermediate base wall and the side walls toward the panel cavity. Each crimp is transverse and continuous along the bottom and sides of the panel and extends past the plane of the base wall and side walls of the panel.

The apparatus includes two crimping assemblies arranged side by side for a double bend and one is used for only a single bend. Each crimping assembly has a removable top die and a stationary bottom die. Pairs of opposed end members with slots defining cam surfaces and pairs of opposed pivoted lever members facilitate the mounting of the top die above the bottom die and against the panel. Drive means including two way cylinders engage the lever arms and cam pins on the lever arm move against the cam surfaces to cause the top die to move past the bottom die in a straight line movement to form a crease in the panel base and side walls to bend the panel. The ends of the panels are moved to provide the desired angle with support arms supported by a base provided to hold the panels at that angle.

BRIEF DESCRIPTION OF THE DRAWINGS

Details of this invention are described in connection with the accompanying drawings which like parts bear similar reference numerals in which.

DETAILED DESCRIPTION

Figure 1:
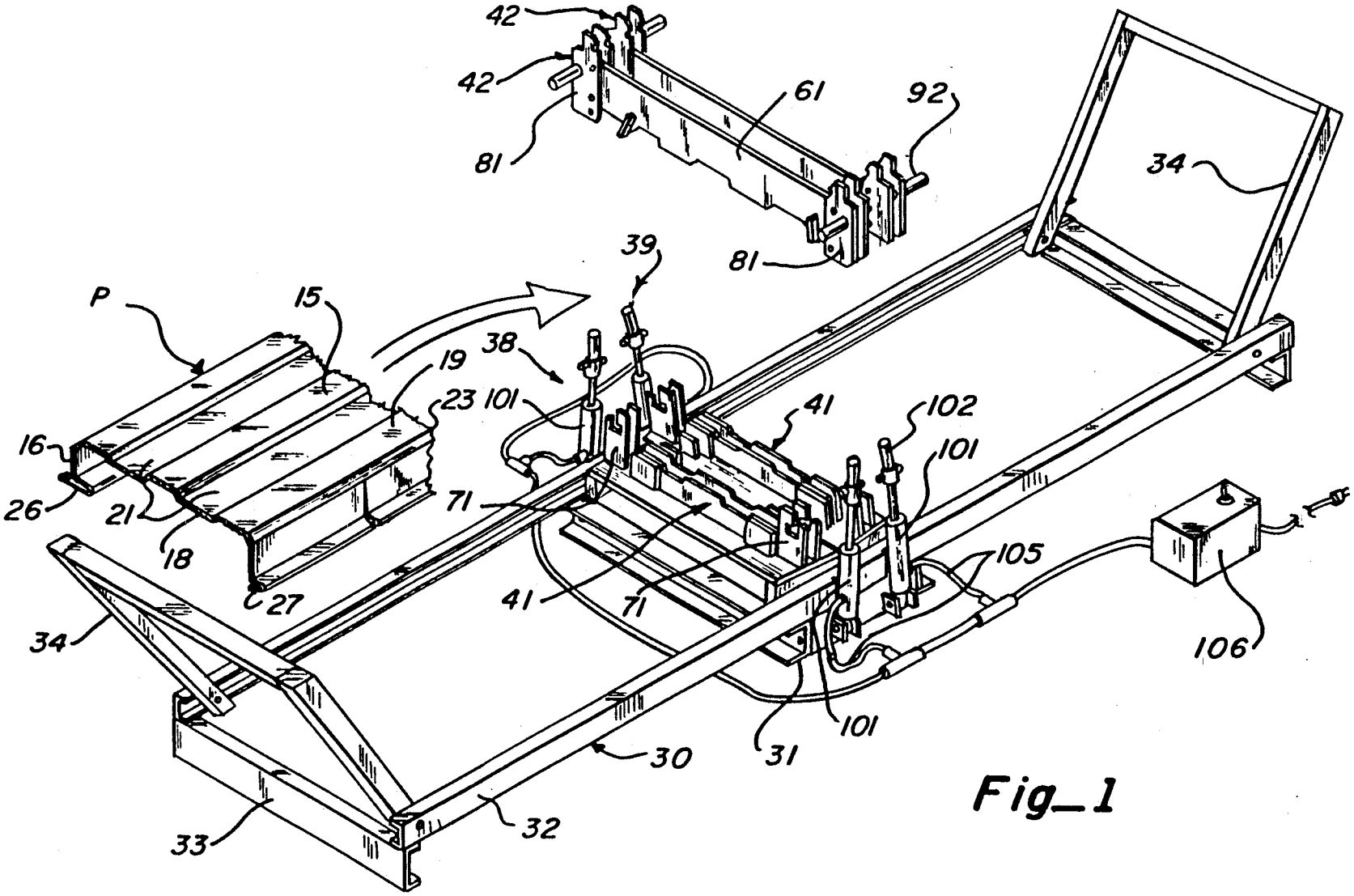
FIG. 1 is a perspective view of bending apparatus embodying features of the present invention with two top dies and a section of a panel to be bent shown in a raised position.
Figure 2:
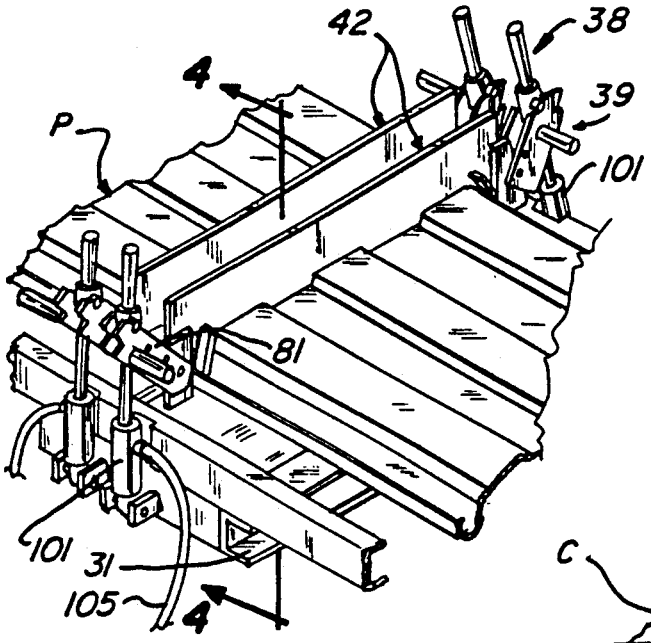
FIG. 2 is a perspective view of a portion of the bending apparatus shown in FIG. 1 with two top dies positioned on the panel to be bent and the drive cylinders in an extended position with actuating pins fitted in cam surfaces of the lever members.

The panel P shown prior to bending is straight and has a generally channel-shaped cross section. This panel typically is formed in roll-forming machine and cut to a selected length. While it is understood panels of different profiles may be bent according to the present invention the panel P shown has an intermediate base or bottom wall 15 and two side walls 16 transversely extending away from opposite side edges of the base wall 15. The panel has oppositely facing side faces 18 and 19 with a cavity, hollow or trough defined by face 18 which is typically the outside face of a building structure. The base wall 15 shown has two laterally spaced longitudinally extending ribs 21 that extend inwardly from the plane of the base wall toward the cavity and has angled corners 23 at the juncture of the base wall and side walls 16 and 17, respectively. Female and male flange connecting portions 26 and 27, respectively, are provided at the extremities of the two side walls 16 to enable two of the panels to be connected side by side at a joint to form a wall or roof structure of a building or the like. A building structure and panel fastening to form a building structure is described in detail in a copending application Ser. No. 810,218 entitled BUILDING AND METHOD AND APPARATUS FOR MAKING that is incorporated herein by reference.

The panel bending apparatus shown includes a base 30 having two laterally spaced transverse bottom beams 31 and two longitudinally spaced longitudinal side beams 32 connected at the ends by transverse end beams 33. A U-shaped pivotal support arm 34 is connected at each end of the longitudinal beams to position the bent end sections of the panel at a selected angle after the creases are made by the crimping assemblies.

The embodiment shown in FIGS. 1-13 has two crimping assemblies 38 and 39 of a similar construction arranged side by side on a central part of base 30 and spaced from one another lengthwise of the base 30. These two crimping assemblies are arranged to form two creases C and thereby two bends to form a panel PD with two bends as is described hereinafter and shown in FIGS. 12 and 13. A panel PS with a single crease C for a single bend is also performed as is described later in connection with FIGS. 14 and 15. Each crimping assembly is of a similar construction and in general each has a stationary bottom die 41 and a movable top die 42.

Figure 13:
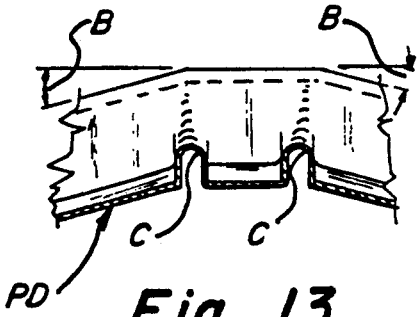
FIG. 13 is a longitudinal sectional view of the panel of FIG. 12.
Figure 12:
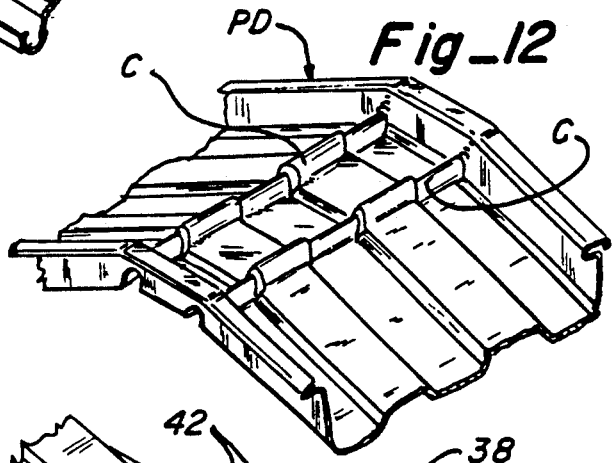
FIG. 12 is a perspective view of the panel with a double bend.
Figure 3:
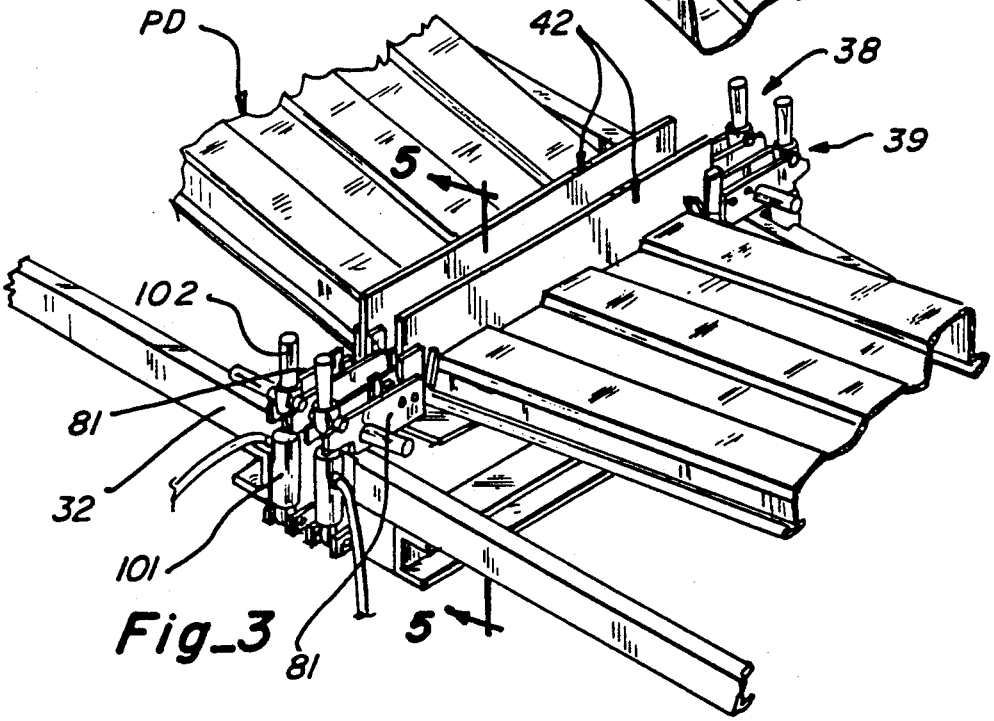
FIG. 3 is a perspective view similar to FIG. 2 with both of the top dies moved to the down position and the panel bent along its length.

The crimping assemblies 38 and 39 are tilted at a slight angle from the vertical at an angle designated A of about 7.5 degrees and the two assemblies tilt toward one another to form an inside angle between the two assemblies of about 15 degrees. The crease or impression C produced in the panel by movable die 42 is at an angle of 15 degrees to the vertical causing the panel to bend with respect to the plane of longitudinal axis of the panel. This 7.5 degree angle causes a symmetrical crease C that is 7.5 degrees on each side of a vertical center line or a 15 degree bend in the panel designated angle B in FIG. 13. The two creases C tilt inwardly to form a flat apex and an outwardly and downwardly inclined sections of a panel PD with a double bend as seen in FIGS. 12 and 13 and typically is used as a roof panel in a building structure.

Figure 4:
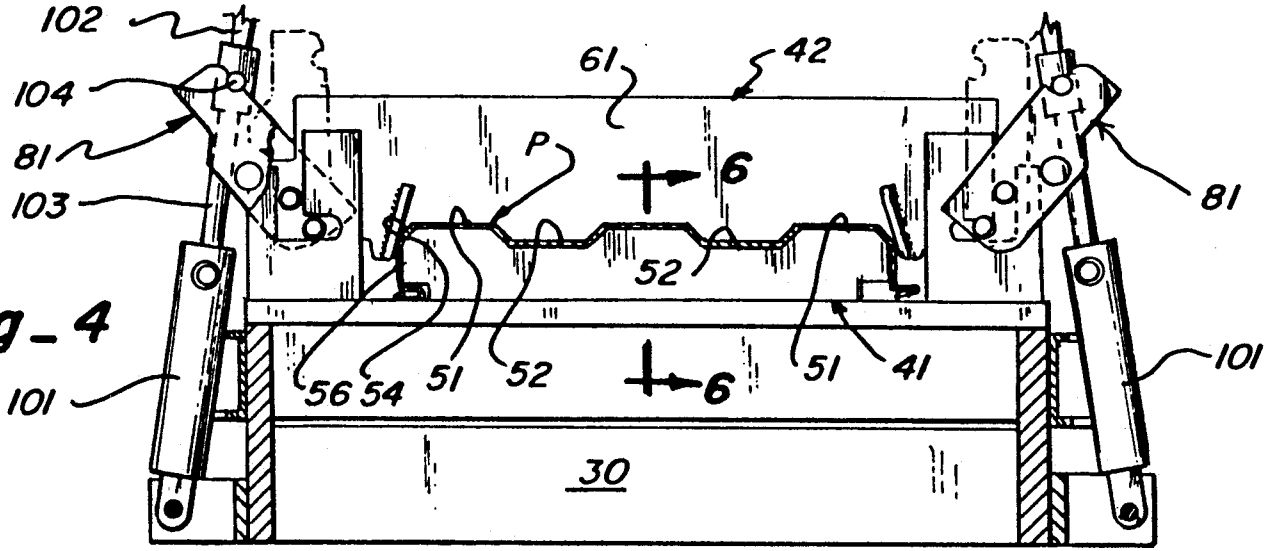
FIG. 4 is a sectional view taken along line 4—4 of FIG. 2.
Figure 6:
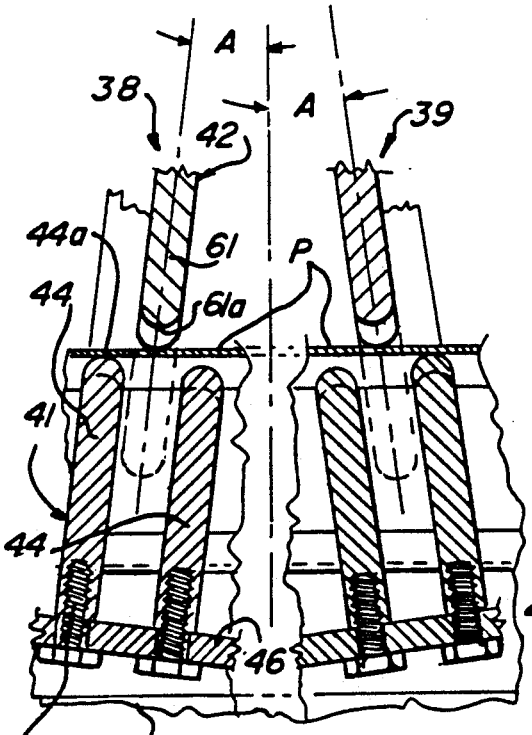
FIG. 6 is a sectional view taken along line 6—6 of FIG. 4.
Figure 7:
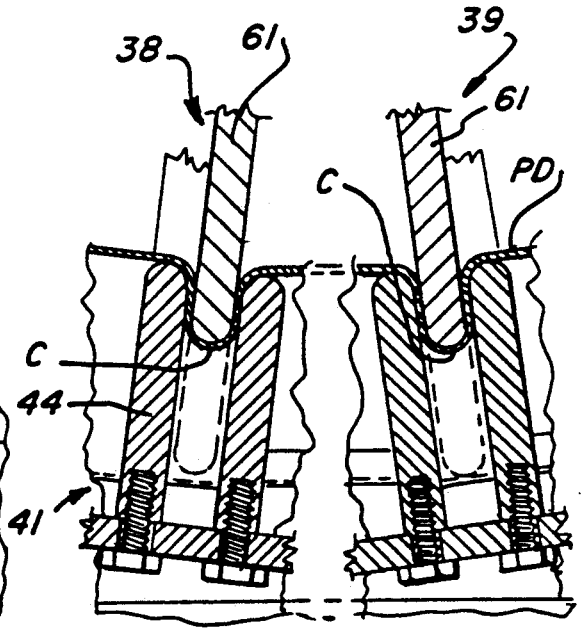
FIG. 7 is a sectional view taken along line 7—7 of FIG. 5.

Each bottom die 41 has a pair of spaced bottom die plates 44 arranged side by side disposed upright and mounted by a bolt fastener 45 to a base plate 46 on base 30. Each bottom die plate 44 has a shape or profile that will mate with the shape of the side face 18 of the panel P that is placed thereon. In particular, as seen in FIG. 4 each bottom die plate 44 has a top edge portion 51 that mates with the base wall 15 of the panel, and two spaced valleys 52 that mate the ribs 21 of the panel, two inclined side edge portions 54 that mate the corners 23 of the panel and two side portions 56 at opposite ends that mate with the two side walls 16 of the panel. The edges of both die plates 44 that fit against the panel face are rounded or radiused as indicated by numeral 44*a* as seen in FIG. 6.

Each top die 42 has a top die plate 61 with a shape or profile that will mate with the panel side face 19 on which it is placed. In particular, the top die plate 61 has a bottom edge portion 62 that mates with the plane of the base wall 15 of the panel and two spaced ridge portions 63 that mate with the ribs 21 of the panel, a pair of inclined side edge portions 64 that mate with the corners 23 of the panel and two side portions 65 at a slight angle to a transverse position relative to said base wall at opposite ends that engage the two side walls 16 of the panel.

Figure 11:
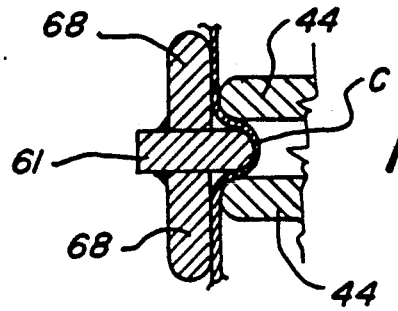
FIG. 11 is a sectional view taken along line 11—11 of FIG. 10.

A stop member 68 is fastened to and projects outwardly from opposite sides of the top die plate 61 as by a weld 69. These stop members 68 are located a selected distance from the rounded edge of the moveable die so that in the extended position the panel will not bulge on each side of the formed crease. This stop member 68 is disposed at a slightly upwardly and inwardly tilted angle to the vertical which is the direction of movement of the top die and is opposite and spaced from the top edge of each bottom die plate 44 to prevent the panel surface adjacent the crease C from forming a bulge in the panel on each side of the crease during the formation of the crease and as best seen in FIG. 11.

A lever action and movement guide mechanism for each movable top die 42 includes a pair of oppositely disposed stationary end members 71 mounted to the base plate 46 beyond the ends of the bottom die 41 which operatively associate with a pair of pivotal lever members 81 on the opposite ends of the top die 42. In general, each associated end and lever members 71 and 81 have co-operating cams and cam surfaces described hereinafter.

Figure 9:
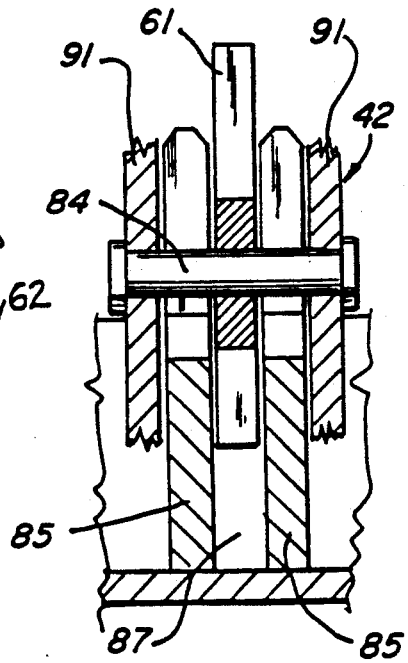
FIG. 9 is a sectional view taken along line 9—9 of FIG. 8.

End member 71 has an inturned L-shaped slot 84 with a vertical slot section 84*a* that is open at the top and a horizontal slot section 84*b* that opens into and extends inwardly from the bottom of slot section 84*a* at right angles thereto. More particularly, as seen in FIG. 9, end member 71 is made up of two parallel spaced plates 85 each with a similar slot and the two slots are in alignment leaving a space 87 between the plates 85.

Lever member 81 is made of two parallel spaced plates 91 of generally rectangular shape that straddle or are on opposite sides of a top die plate 61 of top die 42. A pair of handles 92 extend laterally out from the plates 91 for gripping by the user. A pivot pin 94 is connected between plates 91 intermediate its ends that pivotally attach the lever member 81 to the top die plate 61 and serves as one of the cams described hereinafter. A second cam pin 96 connects between plates 91 and is located between the first cam pin 94 and the bottom edge of the lever member 81. These cams are centered on a longitudinal center line of the lever member 81. A third pin 97 adjacent the other end assists in holding the spaced plates 91 together. A driven cam surface 99 is provided in the upper corner inside of the lever member 81.

The motive power or drive for each top die 42 is provided by a pair of two way hydraulic cylinders 101 mounted on the base 30 beyond the ends of the end members 71. Each cylinder has a rod 103 with a transverse pin 104 on the end. A handle 102 is connected to the free end of the rod 103 for gripping by the user. Fluid lines 105 connect to the cylinder and a control box 106 is actuated to selectively cause the rods to extend and retract. The length of the rod 103 and location of the pin 106 is selected so that in the extended position the rod 103 inserts between the spaced end plates 91 and the pin 104 fits against the cam surface 99 when the lever members are tilted as described hereafter.

Figure 5:
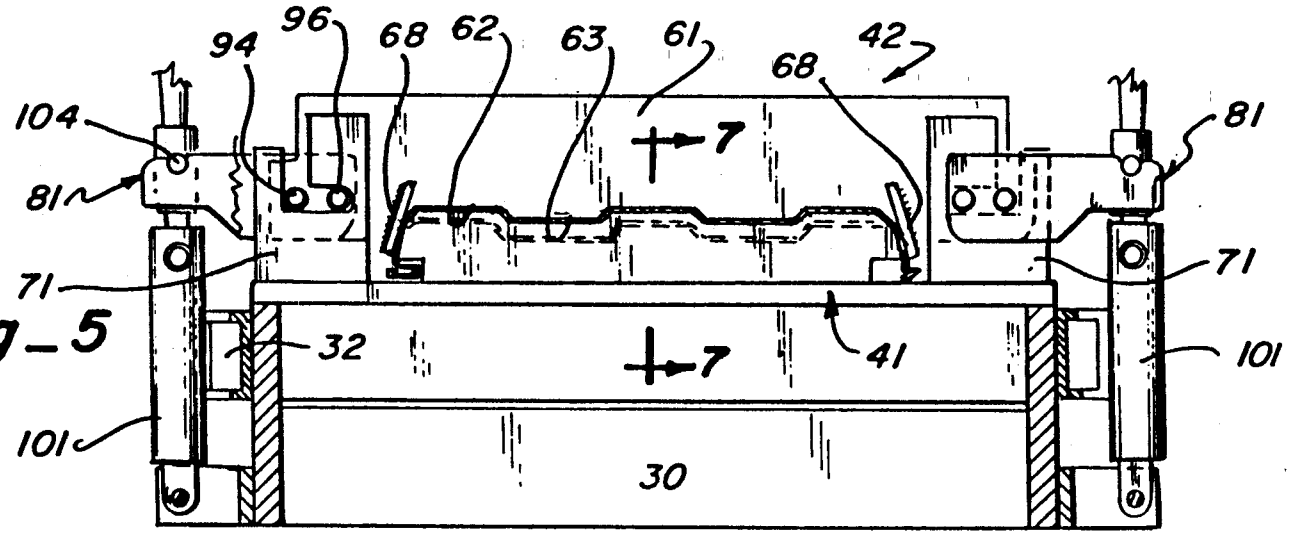
FIG. 5 is a sectional view as taken along line 5—5 of FIG. 3.
Figure 8:
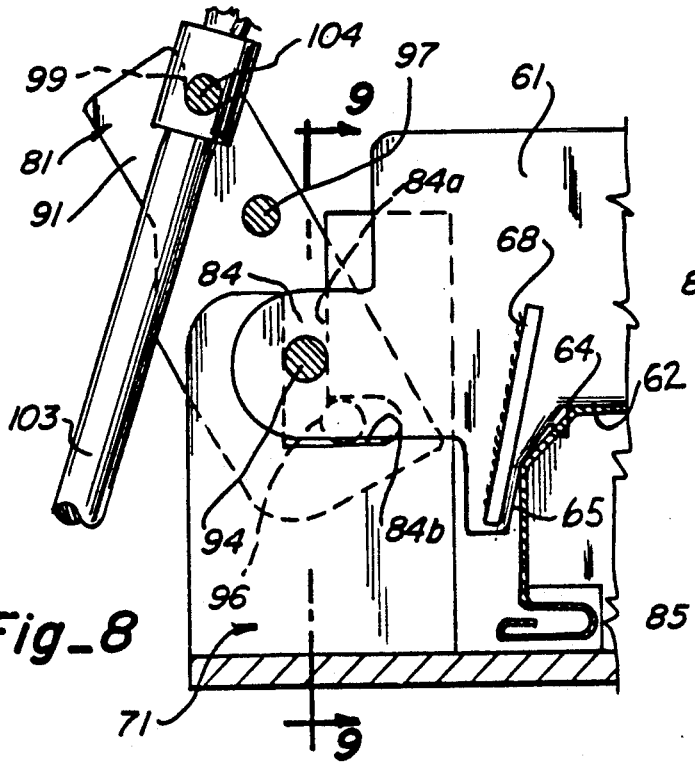
FIG. 8 is an enlarged view of a portion of FIG. 4.
Figure 10:
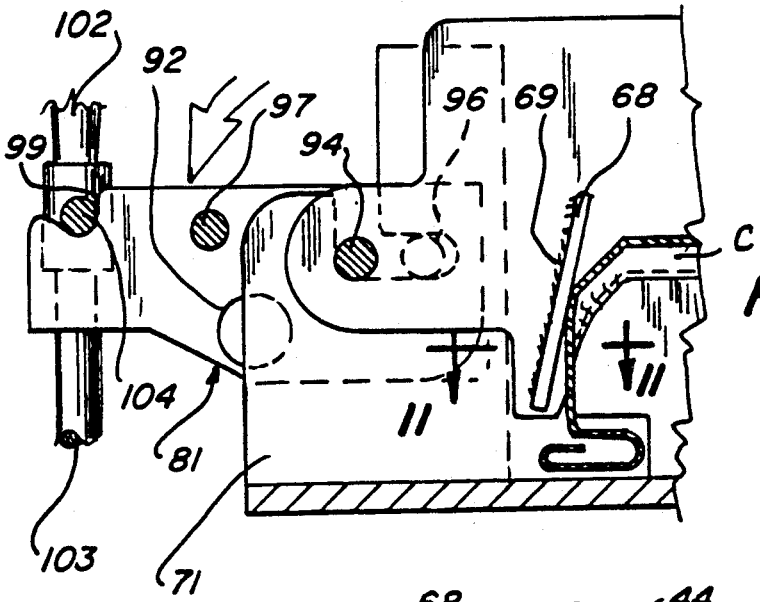
FIG. 10 is an enlarged view of a portion of FIG. 5.

In a full sequence of operation, the lever members 81 are upright and the lower first cam pins 96 are inserted into associated of the vertical sections 84*a* of the slots followed by cam pins 94. Cam pins 96 and 94 are initially both in the vertical section and the lever member 81 is upright or vertically disposed. A slight outward tilt of the lever member 81 causes each bottom cam pin 96 to insert slightly into the associated horizontal slot section 84*b* and the lever arm tilts outwardly at an angle to the vertical as seen in FIG. 8. In this position the top die 42 is pressed firmly against the panel face 19. Each pin 104 is then placed against the associated drive cam surface 99. A retraction of the rod 103 by actuating box 106 causes each bottom cam pin 96 to travel laterally in the associated horizontal slot section 84*b* and each top cam pin 94 to move from the top to the bottom of the vertical slot section 84*a*. This is the vertical stroke of the top die plate 61 which in turn causes the indentation or crease C in the panel. As seen in FIGS. 5 and 10 this crease is transverse and past the plane of the base wall 15 and the plane of the side walls 16 and forms a transverse continuous crease along both the base and sides as seen in FIGS. 10 and 12. The arms 34 may then be extended to a selected angle with the base arm to provide the described angle B for the end sections of panel PD.

Figure 14:
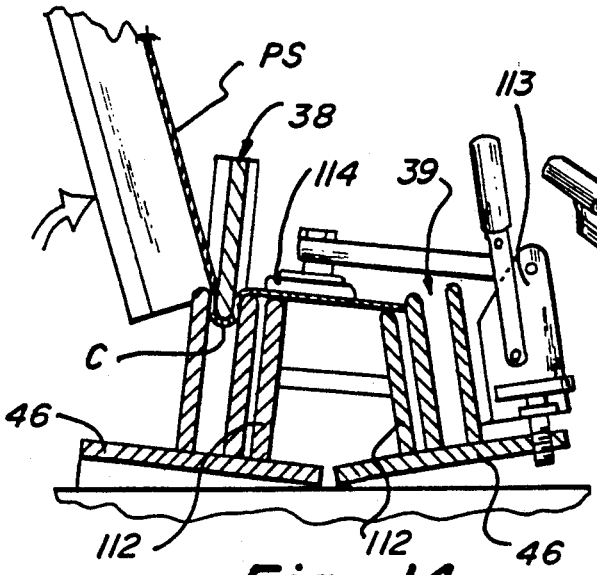
FIG. 14 is a sectional view showing the dies arranged to form a single crease and single bend.
Figure 15:
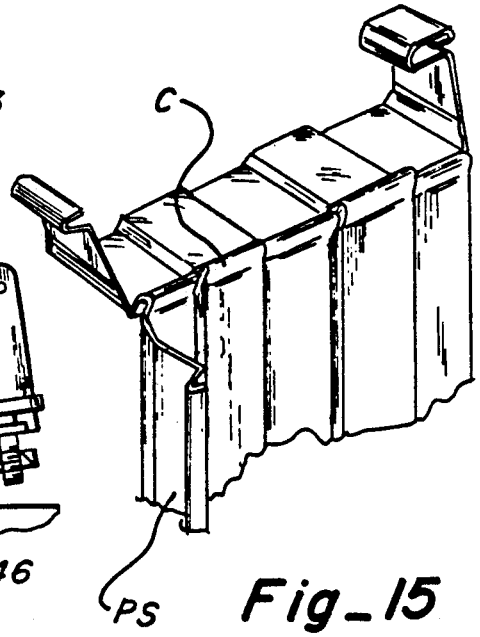
FIG. 15 is a panel formed by the apparatus of FIG. 14.

Referring now to FIGS. 14 and 15 for forming a panel PS with a single crease which may be used as the side wall of a building structure there is provided an additional upright support plate 112 on each base plate 45 and the two are opposite to support the end section of the panel beyond the crease C. A hold down lever arrangement 113 with a contact plate 114 is used to hold the end section of the panel in place. The end edge of the panel PS abuts against the bottom die plate of the non-creasing set of bottom die plates 44. The inside angle of the panel PS shown is bent for a side wall and is about 75 degrees.

Although the present invention has been described with a certain degree of particularity, it is understood that the present disclosure has been made by way of example and that changes in details of structure may be made without departing from the spirit thereof.

What is claimed is:

1. Apparatus for bending a generally channel-shaped panel having a base wall and a pair of substantially parallel side walls arranged substantially perpendicular to said base wall with opposite panel faces and one of said faces defining a cavity comprising:

drive means, stationary die means having a surface configuration to mate with the base wall and at least a portion of the side walls of the panel face defining said cavity, and movable die means responsive to said drive means and having a base edge portion and a pair of opposed side edge portions substantially transverse to said base edge portion to provide a configuration mating with the base wall and at least a portion of the side walls of the other of said panel faces, said movable die means being movable past said stationary die means beyond a plane extending through the base wall and a portion of said side walls to form a crease in said panel that extends inwardly toward said cavity along said base wall and along at least a portion of both of said side walls to perform a bend in said panel.

2. Apparatus as set forth in claim 1 wherein said movable die means includes a single flat die plate with a rounded edge at one end that engages the panel.

3. Apparatus as set forth in claim 2 wherein said movable die carries a pair of stop members extending laterally out from opposite sides of said movable die and disposed a selected distance from said rounded edge, said stop members being opposite said stationary die means and bear against the panel adjacent the crease to prevent a bulge in the panel during creasing.

4. Apparatus as set forth in claim 3 wherein said stop members are arranged at a slight inwardly tilted angle in relation to the direction of movement of said movable die means.

5. Apparatus as set forth in claim 1 wherein said stationary die means includes a pair of parallel spaced, generally upright, flat die plates fastened to a base plate with a gap between said die plates of sufficient distance to permit said movable die means to pass between said die plates in forming said crease.

6. Apparatus as set forth in claim 1 wherein two sets of said stationary and movable die means forming two crimping assemblies arranged side by side and spaced from one another along the length of said panel to form two spaced creases in the panel to form a panel with a double bend.

7. Apparatus as set forth in claim 6 wherein said two crimping assemblies tilt inwardly toward one another at a slight inclined angle to the vertical and form an inside angle therebetween of about 15 degrees.

8. Apparatus as set forth in claim 6 including an upright support plate on each base plate spaced a selected distance from an adjacent die plate, said support plates being adjacent one another to support an end portion of said panel during the forming of a single crease in said panel.

9. Apparatus as set forth in claim 1 wherein said stationary die means and said movable die means are tilted at a slight angle to the vertical and said panel is disposed in a horizontal plane during the formation of said crease.

10. Apparatus as set forth in claim 9 wherein said tilt angle is about 7.5 degrees.

11. Apparatus as set forth in claim 1 wherein said panel has an angled corner at the juncture of the base wall and each side wall and two laterally spaced ribs that extend inwardly from the base wall, said stationary die means and movable die means having corresponding surfaces shaped to mate with said angled corners and ribs.

12. Apparatus as set forth in claim 11 wherein said movable die means has a die plate with a first edge portion that mates with the plane of the base wall, two spaced rib portions that mate with the ribs of the panel, a pair of inclined side edge portions that mate with the angled corners of the panel and two side portions at a slight angle to a transverse position relative to said base wall at opposite ends that engage the two side walls of said panel.

13. Apparatus for bending a generally channel-shaped panel having a base wall and a pair of side walls with opposite panel faces and one of said faces defining a cavity comprising:

a base, drive means on said base, stationary die means on said base, movable die means opposite said stationary die means, and movement guide means for said movable die means, said movement guide means being connected between said drive means and said movable die means and said movement guide means responsive to the movement of said drive means to direct the movement of said movable die means with respect to said stationary die means to form a transverse continuous crease in said panel that extends inwardly toward said cavity along said base and along at least a portion of said said walls to perform a bend in said panel.

14. Apparatus as set forth in claim 13 wherein said movement guide means includes a pair of stationary end members having cam surfaces of a selected configuration and a pair of movable lever members at the opposite ends of said top die means, said movable lever members having cam means that moves in said cam surfaces to guide the movement of said top die means between retracted and extended positions.

15. Apparatus as set forth in claim 14 wherein said cam surfaces are provided by an L-shaped slot in each end member having a vertical section open at the top and a horizontal section opening into the bottom of said vertical section.

16. Apparatus as set forth in claim 14 wherein said cam means includes a first cam pin adjacent the bottom of said lever member and a second cam pin spaced from the first cam pin, said cam pins being disposed along a longitudinal center line of an associated of said lever members.

17. Apparatus as set forth in claim 16 wherein said second cam pin forms a pivotal connection between an associated of said lever members and said movable die plates.

18. Apparatus as set forth in claim 14 wherein said drive means includes a two way cylinder having a transverse drive pin at one end of a cylinder rod, said pin fitting in a cam surface in an associated of said movable lever members.

19. Apparatus as set forth in claim 17 wherein said first cam pin moves first in said vertical section and then in said horizontal section and said second cam pin moves from the top to the bottom of said vertical section and said lever member moves from an outwardly tilted position to a horizontal position in the forming of said crease.

20. Apparatus as set forth in claim 13 wherein said movable die means is detachably mounted to said movement guide means.

21. A method of bending a generally channel-shaped panel having a base wall and a pair of substantially parallel side walls arranged substantially perpendicular to said base wall and having opposite panel faces with one of said faces defining a cavity comprising the steps of:

positioning the face defining the cavity on a first die means having a base edge portion and a pair of opposed side edge portions substantially transverse to said base edge portion to provide an edge surface configuration shape that mates with the panel face against which it is positioned, moving a second die means opposite said first die means transverse to and past said first die means to form a transverse crease in the bottom wall and at least a portion of the side walls that extends inwardly toward said cavity to perform a bend in said panel.

22. A method as set forth in claim 21 wherein said second die means is moved in a straight line.

23. A method of bending a generally channel-shaped panel having a base wall and a pair of side walls and having opposite panel faces with one of said faces defining a cavity comprising the steps of:

positioning the face defining the cavity on a first die means having an edge surface configuration shape that mates with the panel face against which it is positioned, providing a second die means having an edge surface configuration that mates with an opposite face of said panel, providing end members with slots defining cam surfaces at the ends of said first die means, providing pivotal lever members at the ends of said second die means having first and second caming pins that move in slots and against said cam surfaces, providing a driven cam surface on said lever member, and providing two way hydraulic cylinders at opposite ends of said first die means with transverse rods in an associated cylinder rod that fits in said driven cam surfaces with said cam pins in associated of said slots to hold said second die means against said panel and first die means with said rods being retracted in the associated cylinders to cause the cam pins to move in the associated slots causing said first die means to move past said second die means to form a crease in the panel.

* * * * *